US006481418B1

(12) United States Patent
Ristich et al.

(10) Patent No.: US 6,481,418 B1
(45) Date of Patent: Nov. 19, 2002

(54) FUEL PRESSURE REGULATOR

(75) Inventors: Thomas Ristich, Rochester, NY (US); Steven J Fogarassy, Webster, NY (US)

(73) Assignee: Delphi Technologies, Inc., Troy, MI (US)

( * ) Notice: Subject to any disclaimer, the term of this patent is extended or adjusted under 35 U.S.C. 154(b) by 19 days.

(21) Appl. No.: 09/694,512

(22) Filed: Oct. 23, 2000

(51) Int. Cl.[7] ..... F02M 41/00
(52) U.S. Cl. ..... 123/457; 123/514; 137/510
(58) Field of Search ..... 123/514, 463, 123/447, 467, 457; 137/510, 543.23, 533.25; 251/332

(56) References Cited

U.S. PATENT DOCUMENTS 3,099,999 A * 8/1963 Vismara ..... 137/543.23
3,903,923 A * 9/1975 Loup et al. ..... 137/539.5
4,436,112 A 3/1984 Atkins et al.
4,505,296 A 3/1985 Field et al.
4,635,537 A 1/1987 Field
4,756,289 A 7/1988 Rock et al.
4,903,721 A * 2/1990 Maier ..... 137/81.1
5,186,147 A * 2/1993 Bellis ..... 123/457
5,421,306 A * 6/1995 Talaski ..... 123/510
5,482,254 A * 1/1996 Greenwood et al. ..... 251/332
5,558,063 A * 9/1996 Minagawa et al. ..... 123/457
5,609,138 A * 3/1997 Mutschler ..... 123/463
5,673,670 A * 10/1997 Powell et al. ..... 123/463
6,213,413 B1 * 4/2001 Kojima et al. ..... 239/533.11

* cited by examiner

*Primary Examiner*—Carl S. Miller
(74) *Attorney, Agent, or Firm*—Patrick M. Griffin

(57) ABSTRACT

A fuel pressure regulator for supplying fuel to the intake of an internal combustion engine at a substantially constant pressure. The fuel pressure regulator includes a housing defining a fuel chamber in fluid communication with a fluid inlet. The housing further includes a fuel outlet opening in fluid communication with the fuel chamber. The housing defines a seating surface around the outlet opening. A valve body is moveably disposed within the housing and moves between open and closed positions. The valve body contacts and seals against the seating surface and prevents fuel flow through the outlet opening when the valve body is in the closed position. The valve body is biased into the closed position. The valve body includes an extension with at least a portion thereof disposed in the fuel outlet opening to guide the valve body.

20 Claims, 2 Drawing Sheets

FUEL PRESSURE REGULATOR

TECHNICAL FIELD

This invention relates generally to a fuel pressure regulator and more specifically to a fuel pressure regulator for a fuel injector system in an internal combustion engine.

BACKGROUND OF THE INVENTION

Fuel injection systems for automotive engines commonly include electromagnetic fuel injectors that deliver fuel from a fuel rail to the engine inlet manifold adjacent the engine combustion chamber inlet ports. Such fuel injection systems ordinarily include a fuel pressure regulator to control the pressure of the fuel in the rail. In such a system, the pressure in the fuel rail is usually controlled to maintain a constant pressure difference across the injector (i.e. from the pressure in the fuel rail to the pressure in the manifold). The fuel pressure regulator is connected to the inlet manifold to sense the manifold pressure, and to the fuel rail to sense fuel pressure in the rail and to discharge excess fuel from the rail so the fuel pressure in the rail varies with the manifold pressure and is maintained at the desired difference above the manifold pressure.

Conventional fuel pressure regulators include a valve and a valve seat, both made of metal and including precisely machined and polished surfaces designed to contact each other to form a seal. The valve is biased into the closed position by a coil spring that may bias the valve laterally with respect to the seat. Lateral spring bias may cause the valve to seat improperly, causing leakage or other problems. Existing fuel pressure regulators, such as that disclosed in U.S. Pat. No. 4,756,289 to Rock et al. include a ball and socket arrangement to align the valve with the valve seat to provide the necessary rotational motion of the valve to permit alignment of the valve seating surface with the seating surface of the seat. This arrangement includes numerous parts that require high precision machining and polishing operations, as well as numerous assembly steps due to the relatively large number of parts.

SUMMARY OF THE INVENTION

One aspect of the present invention is a fuel pressure regulator for supplying fuel to the intake of an internal combustion engine at a substantially constant pressure. The fuel pressure regulator includes a housing defining a fuel chamber in fluid communication with a fluid inlet. The housing further includes a fuel outlet opening in fluid communication with the fuel chamber. The housing includes a seating surface around the outlet opening. A valve body is moveably disposed within the housing and moves between open and closed positions. The valve body contacts and seals against the seating surface and prevents fuel flow through the outlet opening when the valve body is in the closed position. The valve body is biased into the closed position, and includes an extension with at least a portion thereof disposed in the fuel outlet opening to guide the valve body.

Another aspect of the present invention is a fuel pressure regulator for supplying fuel at a substantially constant pressure. The fuel pressure regulator includes a housing having a fuel inlet and defining a fuel chamber in fluid communication with the fuel inlet. The housing also includes a fuel outlet in fluid communication with the fuel chamber, and a seating surface adjacent the fuel outlet. A valve body is disposed within the housing and is moveable between an opened position permitting fuel flow through the fuel chamber and a closed position preventing fuel flow through the fuel chamber. The valve body is normally biased into the closed position. The valve body includes a rigid molded polymer body portion and an elastomeric seal configured to engage the seating surface when the valve body is in the closed position.

Yet another aspect of the present invention is a fuel pressure regulator for supplying fuel at a substantially constant pressure. The fuel pressure regulator includes a housing having a fuel inlet and a fuel outlet and defining a seating surface. A valve body is moveably disposed within the housing and is moveable between an open position permitting fuel flow through the housing, and a closed position preventing fuel flow through the housing. The valve body includes a guide member, at least a portion of which is disposed in a selected one of the fuel inlet and the fuel outlet to guide the valve body. The valve body has a body portion made of a rigid material, and a seal that is made of a material that is soft relative to the body portion. The valve body is normally biased into the closed position and configured to shift to the open position when pressurized fuel is present in the inlet.

These and other features, advantages and objects of the present invention will be further understood and appreciated by those skilled in the art by reference to the following specification, claims and appended drawings.

DESCRIPTION OF THE PREFERRED EMBODIMENT

Figure 1:
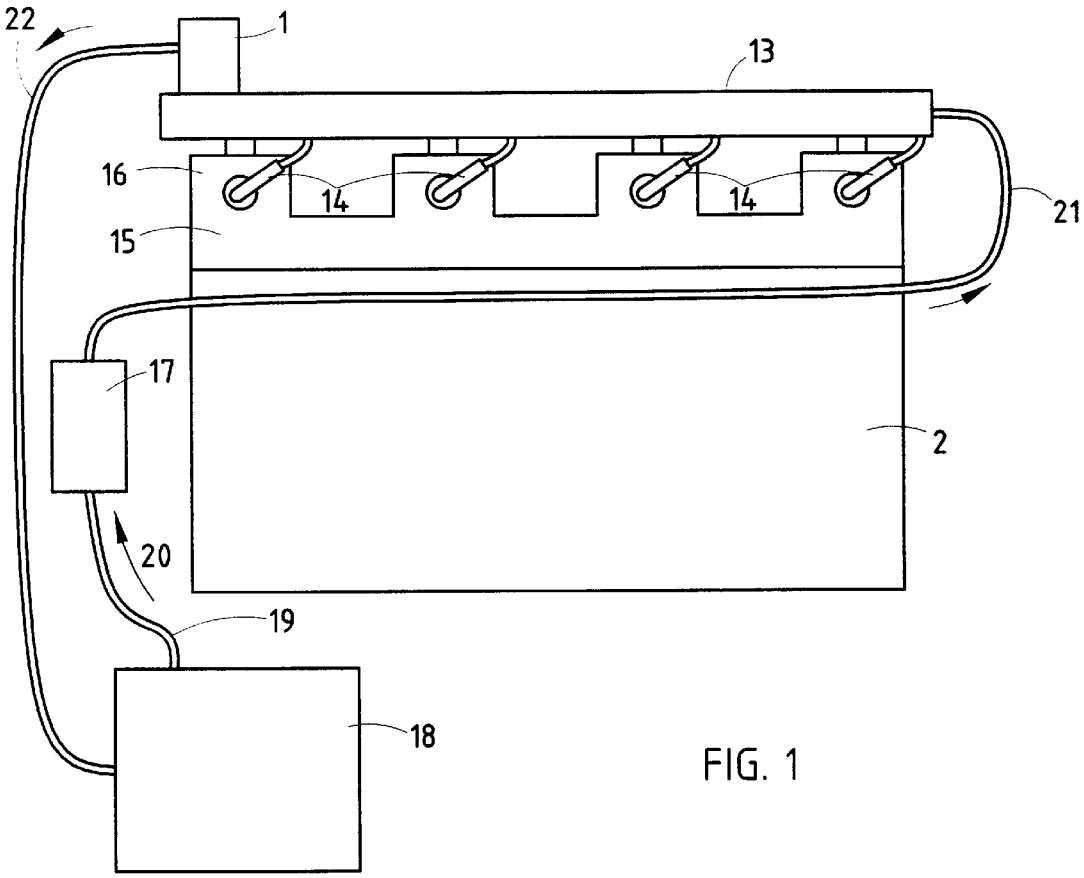
FIG. 1 is a schematic view of an internal combustion engine having a fuel system incorporating the fuel pressure regulator of the present invention.
Figure 2:
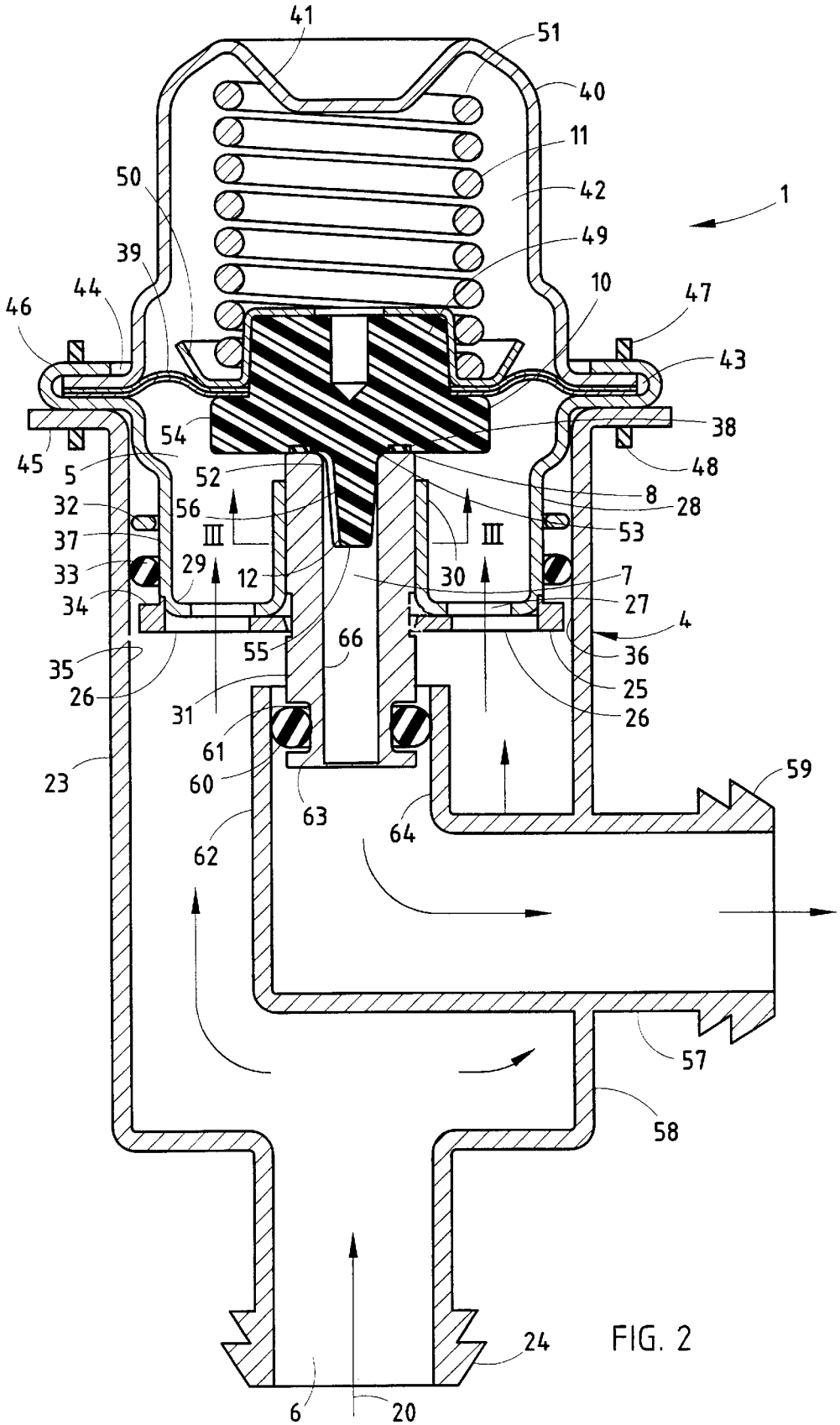
FIG. 2 is a cross-sectional view of a fuel pressure regulator embodying the present invention.

For purposes of description herein, the terms "upper,""lower, ""right, ""left, ""rear, ""front, " "vertical,""horizontal, " and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) designates a fuel pressure regulator embodying the present invention, which is particularly designed for use with a fuel injected internal combustion engine 2, and other similar applications. In the illustrated example, fuel pressure regulator 1 supplies fuel to the intake 3 of the internal combustion engine 2 at a substantially constant pressure. With further reference to FIG. 2, the fuel pressure regulator 1 includes a housing 4 defining a fuel chamber 5 in fluid communication with a fuel inlet 6. The housing 4 further includes a fuel outlet 7 in fluid communication with the fuel chamber 5. The housing 4 defines a seating surface 8 around the outlet 7. A valve body 10 is moveably disposed within the housing 4, and moves between opened and closed positions. The valve body 10 contacts and seals against the seating surface 8 and prevents fuel flow through the outlet opening when the valve body 10 is in the closed position. A coil spring 11 biases the valve body 10 into the closed position. The valve body 10 includes an extension 12 with at least a portion thereof disposed in the fuel outlet 7 to guide the valve body 10 to maintain alignment of a valve body 10 with the valve seat surface 8.

As shown schematically in FIG. 1, a gas or diesel internal combustion engine 2 includes a fuel system incorporating the fuel pressure regulator of the present invention. A fuel rail 13 that supplies fuel to a plurality of fuel injectors 14 which are mounted on an intake manifold 15 which includes a plurality of intake ports 16 leading to the combustion chambers. A fuel pump 17 draws fuel 20 from a fuel tank 18 through a fuel line 19, and supplies high pressure fuel to the fuel rail 13 through a fuel line 21. Excess fuel from the fuel rail 13 is metered through the fuel pressure regulator 1 and returned to the fuel tank 18 by a fuel return line 22.

With reference to FIG. 2, the housing 4 of fuel pressure regulator 1 includes a lower portion 23 that is generally cylindrical in shape, with a fitting 24 that connects to the fuel rail 13 to provide pressurized fuel to the fuel inlet 6. A ring-like member 25 is positioned within the cylindrical portion 23 of housing 4. The ring-like member 25 includes a plurality of openings 26 spaced around member 25. Openings 26 align with a plurality of openings 27 through a lower sidewall 29 of an inner member 28. Inner member 28 includes a cylindrical inner flange 30 that extends upwardly from the lower sidewall 29 to retain a tubular member 31 that forms a portion of the fuel outlet 7 and seating surface 8. An elastomeric seal ring 33 may be clamped onto outer edge portion 34 of ring-like member 25 by a clamp ring 32, such that the seal ring 33 contacts the inner sidewall 35 of the lower portion 23 of housing 4, and also contacts the outer surface 37 of inner member 28, thereby preventing fuel flow through the gap 36 between ring-like member 25 and housing 4.

Valve body 10 is preferably molded from a polymer material, such as polyphenylene sulfide ("PPS"), that is resistant to degradation that would otherwise be caused by contact with the fuel flowing through the fuel pressure regulator 1. An elastomeric ring 38 is integrally molded with the valve body 10, preferably without use of adhesives. Ring 8 seals against the ring-shaped seating surface 8 formed by outlet tube 31. Alternately, the elastomeric ring 38 may be adhesively bonded to valve body 10, and valve body 10 could be made of a conventional metal material. Elastomeric ring 38 provides a relatively soft contact surface, providing a seal regardless of dimensional imperfections in the seating surface 8. This construction of the valve body 10 eliminates the high precision, machined metal surfaces found on conventional valve bodies for fuel pressure regulators, thus eliminating the costly machining operations associated with such conventional valve bodies. A flexible membrane 39 moveably positions the valve body 10 within the housing 4, and seals the fuel within the fuel chamber 5 to prevent fuel flow into the interior cavity 42 of cup-shaped upper member 40 of housing 4. A U-shaped flange 46 of inner member 28 clamps onto a flange 44 of cup-shaped upper member 40, thus securing outer portion 43 of flexible member 39. A clamp ring having upper portion 47 and lower portion 48 secures the U-flange 46 to an outwardly extending flange 45 of cylindrical lower portion 23 of housing 4. A spring retainer 50 is secured to the cylindrical upper portion 49 of valve body 10, and retains the coil spring 11. The upper end 51 of coil spring 11 fits around indented portion 41 of cup-shaped upper member 40. The upper and lower clamp rings 47 and 48 may be utilized to secure the fuel pressure regulator 1 to the fuel rail 13.

Figure 3:
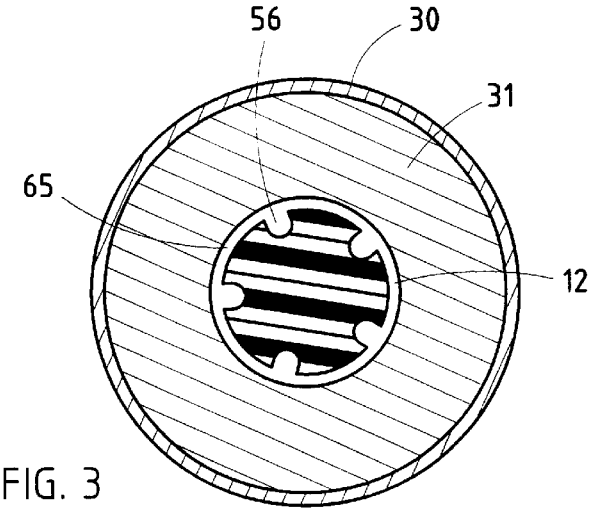
FIG. 3 is a cross-sectional view of the fuel pressure regulator of FIG. 2 taken along the line III—III.

Extension 12 preferably comprises a tapered pin having an upper portion 52 with a radius 53 that fits closely against the radius 54 extending around the seating surface 8 of outlet tube 31 to guide valve body 10 into alignment with the seating surface 8. Lower end 55 of extension pin 12 has a diameter that is substantially less than the inner diameter of outlet tube 31. Extension 12 guides valve body 10 during assembly, and also maintains proper alignment of valve body 10 during operation of the fuel pressure regulator valve 1. Coil spring 11 may generate side forces on valve body 10, which would otherwise result in misalignment and leakage between the seating surface of valve body 10 and the seating surface of outlet member 31. As illustrated in FIG. 3, extension pin 12 includes a plurality of flutes 56 extending vertically along the extension pin 12 to provide fuel flow through the flutes 56 when the valve body 10 is lifted from the seating surface 8. Guide surfaces 65 are formed between flutes 56. The guide surfaces 65 contact radius 54 of outlet tube 31 and/or inner cylindrical sidewall surface 66 of outlet tube 31 to guide valve body 10. Flutes 56 could have a variety of cross-sectional shapes and sizes depending upon the particular application.

A lower tube structure 57 extends through the cylindrical sidewall 58 of lower portion 23 of housing 4, and includes a fitting 59 that attaches to the fuel return line 22. Fittings 24 and 59 are illustrated schematically in FIG. 2. However, it should be understood that a suitable conventional high pressure fuel fitting or other suitable conventional connector is utilized for connecting the fuel pressure regulator 1 to the fuel system of the internal combustion engine 2. A large annular groove 61 in the lower end 63 of outlet tube 31 receives an elastomeric sealing ring 60 that seals against the inner sidewall surface 64 of upwardly extending tubular portion 62 of tube structure 57 to seal off the lower pressure fuel exiting the fuel pressure regulator 1 from the incoming fuel entering through inlet 6. The various housing components, such as lower portion 23, cup-shaped upper portion 40, inner member 28, outlet tube 31, and ring-like member 25 preferably formed of metal, or other suitable material.

The molded polymer valve body 10 provides a cost-effective construction utilizing a molded-in elastomeric ring 38 that eliminates the prior machined and polished surfaces previously required to seal conventional fuel pressure regulator valves. Further, extension 12 guides valve body 10 and maintains alignment between the seating surface of the valve body 10 and the seating surface 8 of the fuel outlet in the housing, thus eliminating the ball and socket arrangement utilized in conventional fuel pressure regulator valves. Furthermore, the guide extension 12 facilitates assembly of the fuel pressure regulator 1 by simplifying the alignment and assembly of the valve body and seating surfaces.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. A fuel pressure regulator for supplying fuel at a substantially constant pressure, comprising:

a housing having a fuel inlet and a fuel outlet, and defining a seating surface; and a valve body movably disposed within said housing and movable between an open position permitting fuel flow through said housing, and a closed position preventing fuel flow through said housing, said valve body including a guide member, at least a portion of which is disposed in a selected one of said fuel inlet and said fuel outlet to guide said valve body, said valve body having a body portion made of a rigid material and a seal that is made of a material that is soft relative to said body portion, said valve body normally biased into said closed position and configured to shift to said open position when pressurized fuel is present in said inlet; and wherein:

said body portion is molded of a polymer material, and said seal is made of an elastomeric material and integrally molded to said body portion without adhesive.

2. A fuel pressure regulator for supplying fuel at a substantially constant pressure, comprising:

a housing having a fuel inlet and a fuel outlet, and defining a seating surface; and a valve body movably disposed within said housing and movable between an open position permitting fuel flow through said housing, and a closed position preventing fuel flow through said housing, said valve body including a guide member, at least a portion of which is disposed in a selected one of said fuel inlet and said fuel outlet to guide said valve body, said valve body having a body portion made of a rigid polymer material and a seal that is made of a material that is soft relative to said body portion, said valve body normally biased into said closed position and configured to shift to said open position when pressurized fuel is present in said inlet.

3. The fuel pressure regulator set forth in claim 2, wherein said guide comprises a pin.

4. The fuel pressure regulator set forth in claim 3, wherein said pin includes at least one flute configured to permit fuel flow therethrough when said valve body is in said open position.

5. The fuel pressure regulator set forth in claim 4, wherein said pin is tapered.

6. The fuel pressure regulator set forth in claim 2, wherein said housing has a tubular portion forming said fuel outlet, said tubular portion having an inner end extending into said fuel chamber and forming said seating surface.

7. A fuel pressure regulator for supplying fuel to the intake of an internal combustion engine at a substantially constant pressure, comprising:

a housing defining a fuel chamber in fluid communication with a fuel inlet, said housing further including a fuel outlet opening in fluid communication with said fuel chamber, said housing defining a seating surface around said outlet;

a valve body movably disposed within said housing and moving between open and closed positions, said valve body contacting and sealing against said seating surface and preventing fuel flow through said outlet opening when said valve body is in said closed position, said valve body biased into said closed position;

said valve body includes an extension with at least a portion thereof disposed in said fuel outlet to guide said valve body; and wherein:

said valve body is molded of a rigid polymer material and includes an elastomeric ring that contacts said seating surface when said valve body is in said closed position.

8. The fuel pressure regulator set forth in claim 7, wherein said extension member includes at least one flute configured to provide fuel flow through said fuel outlet opening when said valve body is in said open position.

9. The fuel pressure regulator set forth in claim 7, wherein said valve body is molded of a rigid polymer material and includes an elastomeric ring that contacts said seating surface when said valve body is in said closed position.

10. A fuel pressure regulator for supplying fuel to the intake of an internal combustion engine at a substantially constant pressure, comprising:

a housing defining a fuel chamber in fluid communication with a fuel inlet, said housing further including a fuel outlet opening in fluid communication with said fuel chamber, said housing defining a seating surface around said outlet;

a valve body movably disposed within said housing and moving between open and closed positions, said valve body contacting and sealing against said seating surface and preventing fuel flow through said outlet opening when said valve body is in said closed position, said valve body biased into said closed position, said valve body including an extension with at least a portion thereof disposed in said fuel outlet to guide said valve body, said valve body molded of a rigid polymer material and including an elastomeric ring that contacts said seating surface when said valve body is in said closed position; and wherein:

said elastomeric ring is integrally molded with said valve body and fixed thereto without adhesives.

11. The fuel pressure regulator set forth in claim 7, wherein said extension member is an elongated tapered pin.

12. The fuel pressure regulator set forth in claim 7, wherein said valve body is biased into said closed position by a spring.

13. The fuel pressure regulator set forth in claim 7, including a flexible membrane having an outer perimeter fixed to said housing, and an opening through said membrane defining an inner edge, said inner edge fixed to said valve body and sealing off said fuel chamber.

14. A fuel pressure regulator for supplying fuel at a substantially constant pressure, comprising:

a housing having a fuel inlet and defining a fuel chamber in fluid communication with said fuel inlet, said housing including a fuel outlet in fluid communication with said fuel chamber, and a seating surface adjacent said fuel outlet;

a valve body disposed within said housing and movable between an open position permitting fuel flow through said fuel chamber and a closed position preventing fuel flow through said fuel chamber, said valve body normally biased into said closed position; and wherein said valve body includes a body portion and an elastomeric seal configured to engage said seating surface when said valve body is in said closed position.

15. The fuel pressure regulator set forth in claim 14, wherein said valve body includes a guide extending into said fuel outlet maintaining said elastomeric seal in alignment with said seating surface.

16. The fuel pressure regulator set forth in claim 15, wherein said guide is a tapered pin.

17. The fuel pressure regulator set forth in claim 16, wherein said tapered pin includes at least one flute configured to permit fuel flow therethrough when said valve body is in said open position.

18. The fuel pressure regulator set forth in claim 17, wherein said housing has a tubular portion forming said fuel outlet, said tubular portion having an inner end extending into said fuel chamber and forming said seating surface.

19. The fuel pressure regulator set forth in claim 18, including:

a spring biasing said valve body into said closed position; and a flexible membrane having an outer perimeter secured to said housing to seal off said fuel chamber; said valve body fixed to said flexible membrane.

20. The fuel pressure regulator set forth in claim 6, including:

a spring biasing said valve body into said closed position; and a flexible membrane having an outer perimeter secured to said housing to seal off said fuel chamber; said valve body fixed to said flexible membrane.

* * * * *